United States Patent [19]

Pritchard, Jr.

[11] Patent Number: 4,655,283

[45] Date of Patent: Apr. 7, 1987

[54] APPARATUS FOR PERFORATING AND PRODUCING A WELL

[75] Inventor: John J. Pritchard, Jr., Harvey, La.

[73] Assignee: Shell Offshore Inc., Houston, Tex.

[21] Appl. No.: 876,631

[22] Filed: Jun. 20, 1986

[51] Int. Cl.[4] ..... E21B 43/11

[52] U.S. Cl. ..... 166/55.1; 175/4.52

[58] Field of Search ..... 166/55.1, 55, 97.5, 166/227, 297, 313; 175/4.52, 4.6, 2

[56] References Cited

U.S. PATENT DOCUMENTS

Re. 25,298 12/1962 Bielstein ..... 175/4.51

2,846,948 8/1958 Lebourg ..... 175/4.52 X 2,938,584 5/1960 Tausch et al. ..... 166/297 X 3,208,533 9/1965 Corley, Jr. ..... 166/313 X

*Primary Examiner*—Stephen J. Novosad

[57] ABSTRACT

An apparatus for perforating the casing wall of a well and producing the well. The apparatus makes use of a dual flow connector having two downwardly-directed ports and carried by a pipe string which is in fluid communication with the upper end thereof. A gun perforator is removably connected to the connector and depends therefrom for closing one port of the connector while a screen is secured to the connector and depends therefrom for closing the other port of the connector.

6 Claims, 3 Drawing Figures

APPARATUS FOR PERFORATING AND PRODUCING A WELL

FIELD OF THE INVENTION

This invention relates to an apparatus for perforating the casing wall of a well and producing the well. The apparatus is provided with a dual flow connector having two downwardly-directed ports and carried by a pipe string which is in fluid communication therewith, and a gun perforator and screen depending from the connector for selectively closing the ports of the connector.

BACKGROUND OF THE INVENTION

Generally, the production of wells in the oil and gas industry is accomplished by lowering a gun perforator into a well to perforate the casing wall before a well screen is positioned in the well to obtain production fluid.

The object of the present invention is to provide an apparatus for both perforating and producing a well so as to allow both operations to be done using a single apparatus which can be run into a well on a single trip. The apparatus is equipped to produce well fluid before and after the well starts to produce sand in the well fluid.

SUMMARY OF THE INVENTION

The present invention is directed to an apparatus for perforating and producing a well. The apparatus is provided with a dual flow connector having two downwardly-directed inlet ports and carried by a pipe string which is in fluid communication therewith. A gun perforator and well screen depend from the connector at the inlet ports of the connector.

In operation after the apparatus is lowered into the well to a selected depth, the gun perforator is activated causing the casing wall to be perforated and the gun to disengage from the dual flow connector and drop to the bottom of the well. Production fluid enters the pipe string from both inlet ports of the dual flow connector but mainly through the open port where the gun had been connected. When sand is observed in the production fluid at the ocean or earth surface, a plug can be dropped or lowered to seal the open inlet port previously closed by the gun perforator so as to cause production fluid to pass through the well screen before entering the pipe string.

An advantage of the present invention is that a well can be perforated and produced using a single apparatus.

Another advantage of this invention is that the production fluid can be diverted through the well screen by installation of a plug in the dual flow connector to restrict flow through one of the inlet ports.

The various features of novelty which characterize the invention are pointed out with particularity in the claims forming a part of this disclosure. For a better understanding of the invention, its operating advantages and specific objects obtained by its uses, reference should be made to the accompanying drawings and descriptive matter in which there are illustrated preferred embodiments of the invention.

DESCRIPTION OF THE PREFERRED EMBODIMENT

Figure 1:
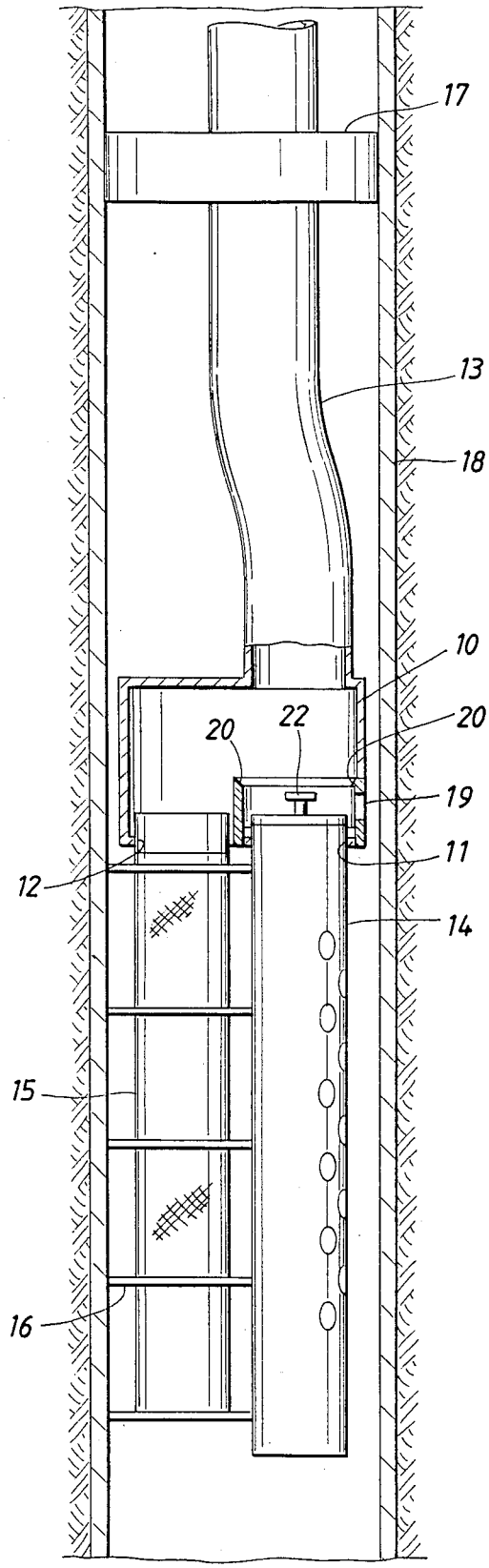
FIG. 1 is a diagrammatic view of an apparatus for perforating and producing a well.

Referring to FIG. 1 of the drawing, an apparatus for perforating and producing a well 18 may include a dual flow connector 10 carried by the lower end of a pipe string 13 and adapted to be in fluid communication with the pipe string 13. The dual flow connector 10 has two downwardly-directed inlet ports 11 and 12. A gun perforator 14 is removably secured to the connector 10 thereby closing port 11. A well screen or slotted liner 15, preferably pre-packed with a permeable sand and epoxy mixture, is fixedly secured to the connector 10 so as to close port 12.

A protection device 16, such as metal centralizer rings, may be carried by the screen 15 and interposed between the well screen 15 and the gun perforator 14 to minimize contact of the perforator 14 with the screen 15 to prevent damage to the screen when the gun is fired.

A packer 17 carried by the pipe string 13 may be located above the apparatus and positionable within the interior bore of the casing of the well 18 in a fluid-tight manner.

A fluid discharge port 19 through a wall of the connector 10 may be provided for circulating fluid therethrough.

Figure 3:
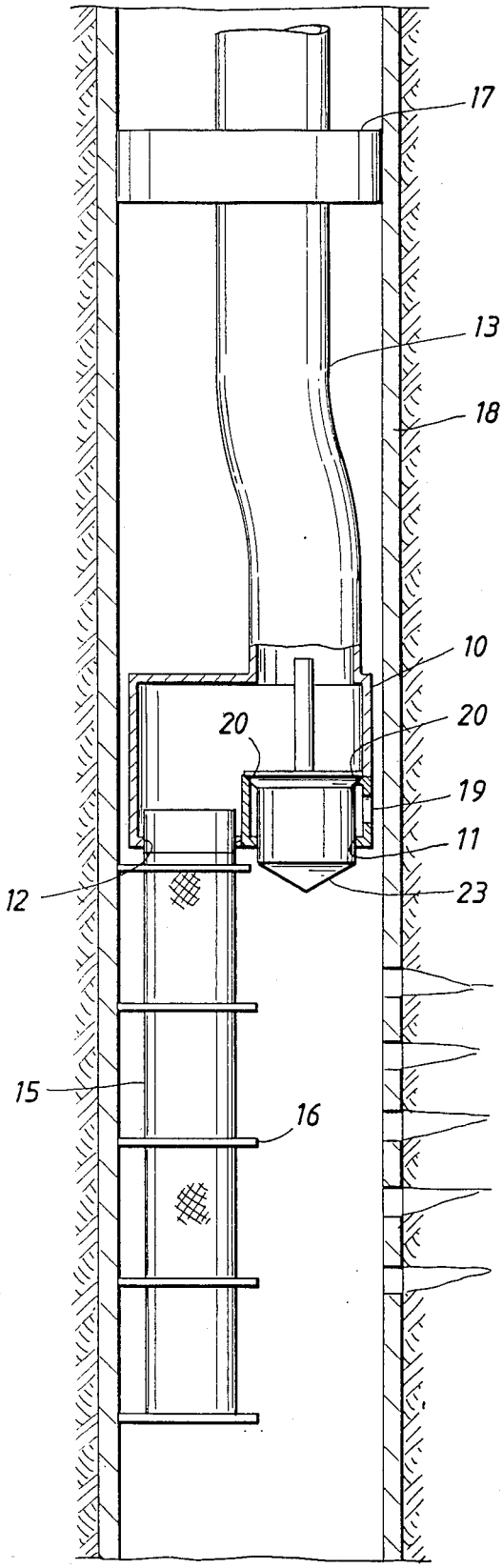
FIG. 3 is a diagrammatic view of a plug installed in a dual flow connector to divert production fluid through a well screen.

Landing surfaces 20 located above the discharge port 19 provide a means for positioning a closure member 23, such as a plug (FIG. 3), in a fluid-tight manner.

In operation, the apparatus is lowered into the well 18 on a running pipe string 13 to a selected depth where the casing of the well is to be perforated.

Fluid from a source (not shown), located on, say, a vessel on the ocean surface, may be pumped down the running pipe string 13 and through the circulation discharge port 19 to remove any debris on or near the firing head 22 of the gun perforator 14.

The packer 17 above the apparatus is positioned within the interior bore of the casing to obtain a fluid-tight seal in a manner well known to the art.

The gun perforator 14 is activated in a manner well known to the art, such as by dropping a weight (not shown) to perforate the casing wall 18 but not the well screen 15. The protection device 16 interposed between the well screen 15 and the gun perforator 14 minimizes contact of the gun perforator 14 with the well screen 15.

Figure 2:
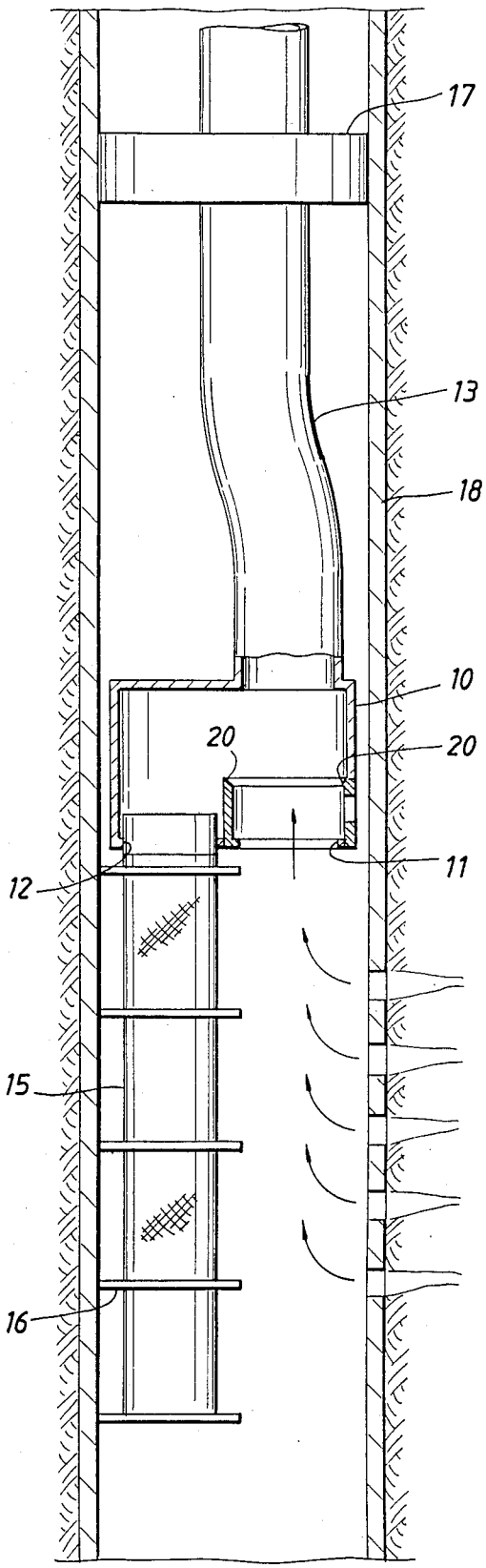
FIG. 2 is a diagrammatic view of a perforated wall casing after the gun perforator has dropped off.

The perforator 14 disengages (FIG. 2) from the connector 10 and production fluid enters both ports 11 and 12 of the apparatus.

When sand is observed in the production fluid at the ocean or earth's surface, a closure member, such as a plug 23, may be positioned on the landing surfaces 20 in a manner well known to the art to form a fluid-tight seal. As a result, production fluid will enter the pipe string 13 through the well screen 15 and port 12.

Thus, it can be seen that the above-mentioned objective may be accomplished, based on the description of the preferred embodiment, by practicing the above-described method.

What is claimed is:

1. An apparatus for perforating the casing wall of a well and producing the well, said apparatus comprising:

a pipe string operatively connected to said apparatus for lowering said apparatus into said well casing, dual flow connector means carried by the lower end of said pipe string and adapted to be in fluid communication therewith, said connector means having two downwardly-directed fluid inlet ports, perforator means removably secured to said connector means and depending therefrom for closing one port of said connector means, and screen means fixedly secured to said connector means and depending therefrom for closing the other port of said connector means.

2. The apparatus of claim 1 including protector means interposed between said screen means and said perforator means for minimizing contact of said perforator means with said screen means.

3. The apparatus of claim 1 including packer means carried by said pipe string and located above said apparatus, said packer means having substantially the same diameter as the casing to be perforated and positionable within the interior bore of said casing in a fluid-tight manner.

4. The apparatus of claim 1 wherein said dual flow connector means includes fluid discharge port means through a wall of said connector means above said perforator means for circulating fluid therethrough.

5. The apparatus of claim 4 wherein said dual flow connector means includes landing nipple means positioned above said discharge port means adapted for positioning a closure member adjacent said port means.

6. The apparatus of claim 5 wherein said dual flow connector means includes a closure plug positionable on said landing nipple means for closing the discharge port means through a wall of said dual flow connector means.

* * * * *